US009490566B2

(12) United States Patent
Higgy

(10) Patent No.: US 9,490,566 B2
(45) Date of Patent: Nov. 8, 2016

(54) TERMINAL HOLDER

(71) Applicant: Tyco Electronics Corporation, Berwyn, PA (US)

(72) Inventor: Mohamed Hussein Higgy, Redwood City, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/666,903

(22) Filed: Mar. 24, 2015

(65) Prior Publication Data

US 2016/0285189 A1 Sep. 29, 2016

(51) Int. Cl.

| | |
|---|---|
| ***H01R 24/00*** | (2011.01) |
| ***H01R 13/42*** | (2006.01) |
| ***H01R 4/02*** | (2006.01) |
| ***H01R 43/02*** | (2006.01) |
| ***H01R 43/16*** | (2006.01) |

(52) U.S. Cl.

CPC ..... *H01R 13/42* (2013.01); *H01R 4/02* (2013.01); *H01R 43/02* (2013.01); *H01R 43/16* (2013.01)

(58) Field of Classification Search

CPC ..... H01R 13/42; H01R 4/02; H01R 43/02; H01R 13/193; H01R 13/114; H01R 12/598; H01R 12/594

USPC ..... 439/626

See application file for complete search history.

(56) References Cited

U.S. PATENT DOCUMENTS

| | | | | |
|---|---|---|---|---|
| 8,476,539 | B2 * | 7/2013 | Ilchev | H01L 31/02008 174/126.1 |
| 8,608,498 | B2 * | 12/2013 | Suzuki | H01R 13/193 439/262 |
| 2008/0188132 | A1 * | 8/2008 | Nagata | H01R 12/598 439/626 |
| 2011/0195593 | A1 * | 8/2011 | McGrath | H01R 12/594 439/345 |
| 2015/0050838 | A1 * | 2/2015 | Copper | H01R 13/114 439/626 |

* cited by examiner

*Primary Examiner* — Jean F Duverne

(57) ABSTRACT

A terminal holder is provided for connecting a cable to a connector or another cable. The terminal holder includes a base plate configured to be held proximate an end of the cable. The base plate includes an edge. Terminal sleeves extend from the edge of the base plate for holding cable terminals of the cable and connector terminals of the connector or of the other cable. The terminal sleeves have internal passages extending from a cable end to a connector end. The internal passage is configured to receive a corresponding cable terminal therein through the cable end. The internal passage is configured to receive a corresponding connector terminal therein through the connector end such that the corresponding cable terminal and the corresponding connector terminal are engaged in electrical contact with each other within the internal passage.

20 Claims, 8 Drawing Sheets

TERMINAL HOLDER

BACKGROUND OF THE INVENTION

The subject matter described and/or illustrated herein relates generally to terminal holders for ribbon cables.

Photovoltaic (PV) systems produce electricity from solar energy. Various components of the PV system are interconnected using cables. For example, components of PV systems that are interconnected via cables may include PV modules or arrays that are used to generate electricity (e.g., solar panels and/or the like), and/or other PV components used within a PV system (e.g., power storage devices, sensors, controllers, and/or the like). While PV systems are often used on land, for example to provide electrical power to a residence or commercial building, PV systems may be used in outer space, in orbit around the earth, and/or on-board satellites.

Known connectors that are used to connect cables to other components are not without disadvantages. For example, the terminals of many connectors are terminated to the conductor terminals of the corresponding cable using solder. But, such solder terminations may fail due to extreme thermal cycling experienced in outer space and earth orbit environments. Moreover, many connectors use fluorosilicone components, for example as sealing gaskets and/or within cable clamps (e.g., for strain relief) of the connectors that clamp to the cable. Such fluorosilicone materials may also fail due to the extreme thermal cycling experienced in outer space and earth orbit environments. Accordingly, at least some known connectors are not suitable for use in outer space and/or earth orbit environments, particularly over relatively extended periods of time. For example, at least some known connectors may shorten the life expectancy of a satellite.

BRIEF DESCRIPTION OF THE INVENTION

In an embodiment, a terminal holder is provided for connecting a cable to a connector or another cable. The terminal holder includes a base plate configured to be held proximate an end of the cable. The base plate includes an edge. Terminal sleeves extend from the edge of the base plate for holding cable terminals of the cable and connector terminals of the connector or of the other cable. The terminal sleeves have internal passages extending from a cable end to a connector end. The internal passage is configured to receive a corresponding cable terminal therein through the cable end. The internal passage is configured to receive a corresponding connector terminal therein through the connector end such that the corresponding cable terminal and the corresponding connector terminal are engaged in electrical contact with each other within the internal passage.

In an embodiment, a connector and cable assembly includes a cable having cable terminals, a connector having connector terminals, and terminal sleeves for holding the cable terminals and the connector terminals. The terminal sleeves have internal passages that extend from a cable end to a connector end. The internal passage is configured to hold a corresponding cable terminal received through the cable end. The internal passage is configured to hold a corresponding connector terminal received through the connector end such that the corresponding cable terminal and the corresponding connector terminal are engaged in electrical contact with each other within the internal passage.

In an embodiment, a method is provided for connecting a cable to a connector or another cable. The method includes inserting first terminals of the cable into first ends of terminal sleeves that extend from a base plate, holding the base plate proximate an end of the cable such that the first terminals are retained within the terminal sleeves, and inserting second terminals of the connector or other cable into second ends of the terminal sleeves such that corresponding first and second terminals are engaged in electrical contact with each other within the corresponding terminal sleeve.

DETAILED DESCRIPTION OF THE INVENTION

Figure 1:
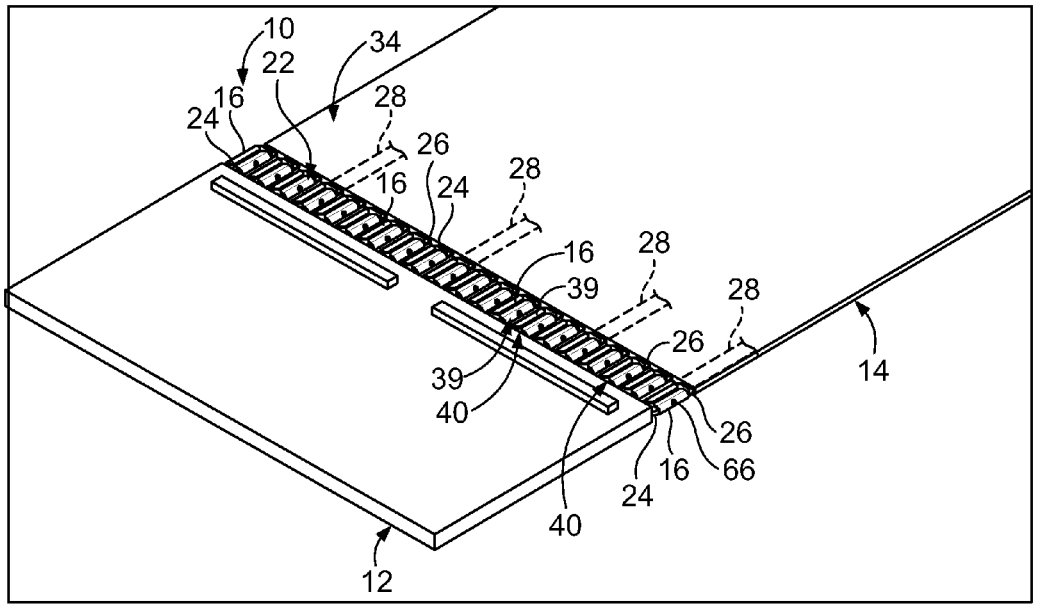
FIG. 1 is a perspective view of an embodiment of a connector and cable assembly as fully assembled.
Figure 2:
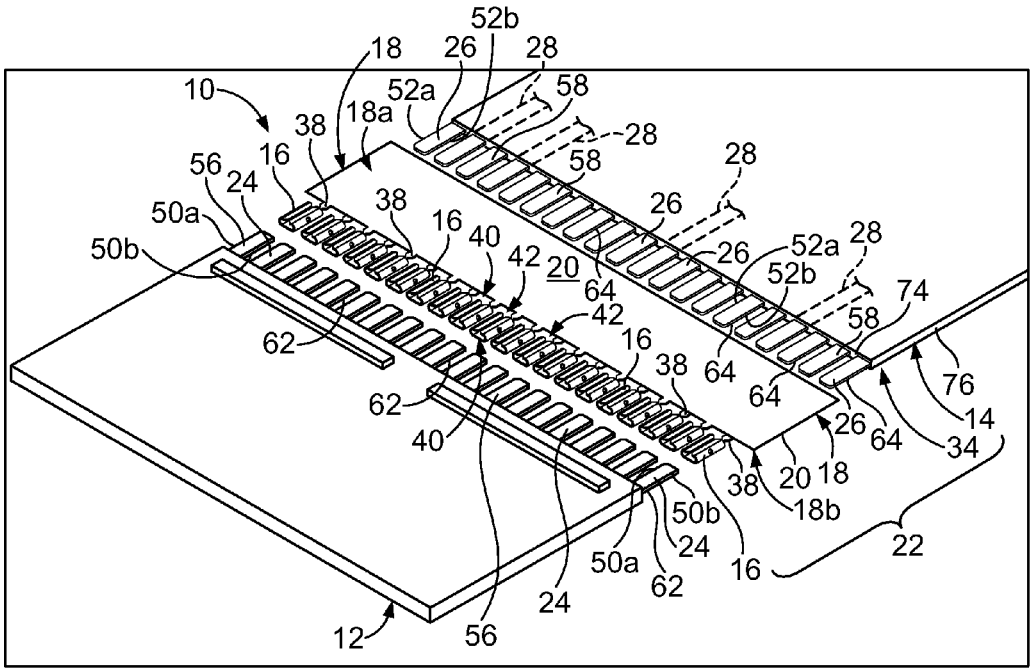
FIG. 2 is an exploded perspective view of the connector and cable assembly shown in FIG. 1 illustrating an embodiment of terminal holders that are used during the process of assembling the connector and cable assembly.

FIG. 1 is a perspective view of an embodiment of a connector and cable assembly 10 as fully assembled. FIG. 2 is an exploded perspective view of the assembly 10. Referring now to FIGS. 1 and 2, the assembly 10 includes an electrical connector 12, an electrical cable 14, and terminal sleeves 16 that facilitate interconnecting the connector 12 and the cable 14. As will be described below, one or more terminal holders 18 that include the terminal sleeves 16 are used during the process of connecting the cable 14 to the connector 12. A portion of each terminal holder 18 (e.g., a base plate 20) is separated from the terminal sleeves 16 after the connector 12 and the cable 14 have been interconnected. Accordingly, the terminal holders 18 are not labeled in FIG. 1 and the base plate 20 is not shown or therefore labeled in FIG. 1. The terminal holders 18 will be described in more detail below with reference to FIG. 3.

The connector 12 and the cable 14 are mounted and terminated, respectively, to corresponding electrical components (not shown). Each of the electrical components may be any type of electrical component. In some embodiments, one or more of the electrical components is an electrical component of a photovoltaic (PV) system. Examples of electrical components of PV systems include, but are not limited to, PV modules or arrays that are used to generate electricity (e.g., solar panels and/or the like), and/or other PV components used within a PV system (e.g., power storage devices, sensors, controllers, and/or the like). In some embodiments, the electrical components are components of a PV and/or other system that is configured to operate in outer space, that is configured to operate in orbit around the earth, and/or that is located on-board a satellite. Accordingly, in some embodiments, the assembly 10 is configured to operate in outer space, is configured to operate in orbit around the earth, and/or is located on-board a satellite.

The connector 12 and the cable 14 are configured to be connected together at an interface 22 to electrically connect the electrical components together. The connector 12 and the cable 14 may be connected together at the interface 22 to transmit power and/or data along the transmission path between the connector 12 and the cable 14, and thus between the electrical components. Although shown as being connected to a single cable 14 using the terminal sleeves 16 of one or more terminal holders 18, the connector 12 is not limited to being connected to only one cable. Rather, the connector 12 may be connected to any number of cables using the terminal sleeves of one or more terminal holders. For example, in some other embodiments, the connector 12 is connected (e.g., using two terminal holders) to two cables that are stacked on each other such that the terminals 24 of the connector 12 may be sandwiched between corresponding terminals of the two cables. Another example includes connecting (e.g., using two or more terminal holders) the connector 12 to two or more cables that are arranged side-by-side with each other.

The terminal sleeves and terminal holders described and illustrated herein are not limited to being used to connect a cable to a connector. Rather, the cable 14 may be connected to one or more other electrical cables (not shown) using the terminal sleeves of one or more terminal holders. Moreover, although shown as being connected to a single connector 12 using the terminal sleeves 16 of one or more terminal holders 18, the cable 14 is not limited to being connected to only one connector. Rather, the cable 14 may be connected to any number of connectors using the terminal sleeves of one or more terminal holders. For example, in some other embodiments, an end 34 of the cable 14 is split into two or more segments that each can be connected (e.g., using two terminal holders for each segment) to one or more corresponding connectors such that the cable 14 can be connected to two or more connectors (e.g., that are arranged side-by-side with each other, that are arranged approximately perpendicular to each other [by folding the end 34 of the cable 14 at the division(s) between the segments), and/or that are arranged at an oblique angle to each other [by folding the end 34 of the cable 14 at the division(s) between the segments]).

In the illustrated embodiment, the connector 12 is low profile connector (e.g., a wafer) that has a generally short and generally wide configuration such that the connector 12 has a larger side-to-side dimension as compared to a top-to-bottom dimension. The low profile aspect of the connector 12 may allow the connector 12 to be positioned within, and routed through, relatively small spaces. Moreover, the low profile aspect of the connector 12 may enable the connector 12 to be arranged side-by-side in a row with one or more other connectors (not shown) and/or may enable the connector 12 to be stacked in a column with one or more other connectors. Optionally, the connector 12 is mounted to a panel (not shown).

The connector 12 includes terminals 24 that are configured to be engaged in electrical contact with corresponding terminals 26 of the cable 14 at the interface 22. In the illustrated embodiment, the terminals 24 are approximately flat terminals that have an approximately flat (i.e., planar) shape. As used herein, an "approximately flat terminal" may have any level of flatness that enables the approximately flat terminal to be engaged in electrical contact with another terminal. An "approximately flat terminal" may be approximately flat but may additionally have some surface contour, undulation, protrusions, depressions, and/or the like. The terminals 24 may be copper-based and/or other electrical terminals, depending on the particular application. Although twenty terminals 24 are shown, the connector 12 may include any number of the terminals 24. The terminals 24 may be referred to herein as "connector terminals" and/or "second terminals".

In the illustrated embodiment, the cable 14 is a ribbon (e.g., approximately flat) cable having the generally shape of a ribbon. In other embodiments, the cable 14 may have another shape, such as, but not limited to, a cylindrical shape. The ribbon shape of the cable 14 may allow the cable 14 to be positioned within, and routed through, relatively small spaces. Moreover, the ribbon shape of the cable 14 may allow the cable 14 to be arranged side-by-side in a row with one or more other cables (not shown) and/or may enable the cable 14 to be stacked in a column with one or more other cables. Optionally, the connector 12 is mounted to a panel (not shown).

The cable 14 includes conductors 28 that include the terminals 26. The illustrated embodiments of the conductors 28 of the ribbon cable 14 have an approximately flat (i.e., planar) shape. But, one or more of the conductors 28 of the ribbon cable 14 may alternatively have another shape, such as, but not limited to, an approximately cylindrical shape. In the illustrated embodiment, the terminals 26 of the cable 14 are approximately flat terminals that have an approximately flat shape. But, the terminals 26 may have any other shape (regardless of the shape of the conductors 28), such as, but not limited to, an approximately cylindrical shape. For example, in embodiments wherein the cable 14 has cylindrical conductors (e.g., the cylindrical conductor 228 shown in FIG. 13 and the cylindrical conductors **328*a* and 328*b* shown in FIG. 15), ends of the cylindrical conductors of the cable 14 may be used as the terminals 26 (e.g., the end 230 shown in FIG. 13 and the ends 330*a* and 330*b* shown in FIG. 15) or pins (not shown) may terminate the conductors 28 of the cable 14 (regardless of whether or not the conductors 28 have an approximately flat shape). The terminals 26 may be copper-based and/or other electrical terminals, depending on the particular application. Although twenty terminals 26 are shown, the cable 14 may include any number of the terminals 26. The terminals 26 may be referred to herein as "cable terminals" and/or "first terminals". The cable 14 may include any number of the conductors 28. Only some of the conductors 28 are shown (in phantom) in FIGS. 1 and 2** for clarity.

Figure 3:
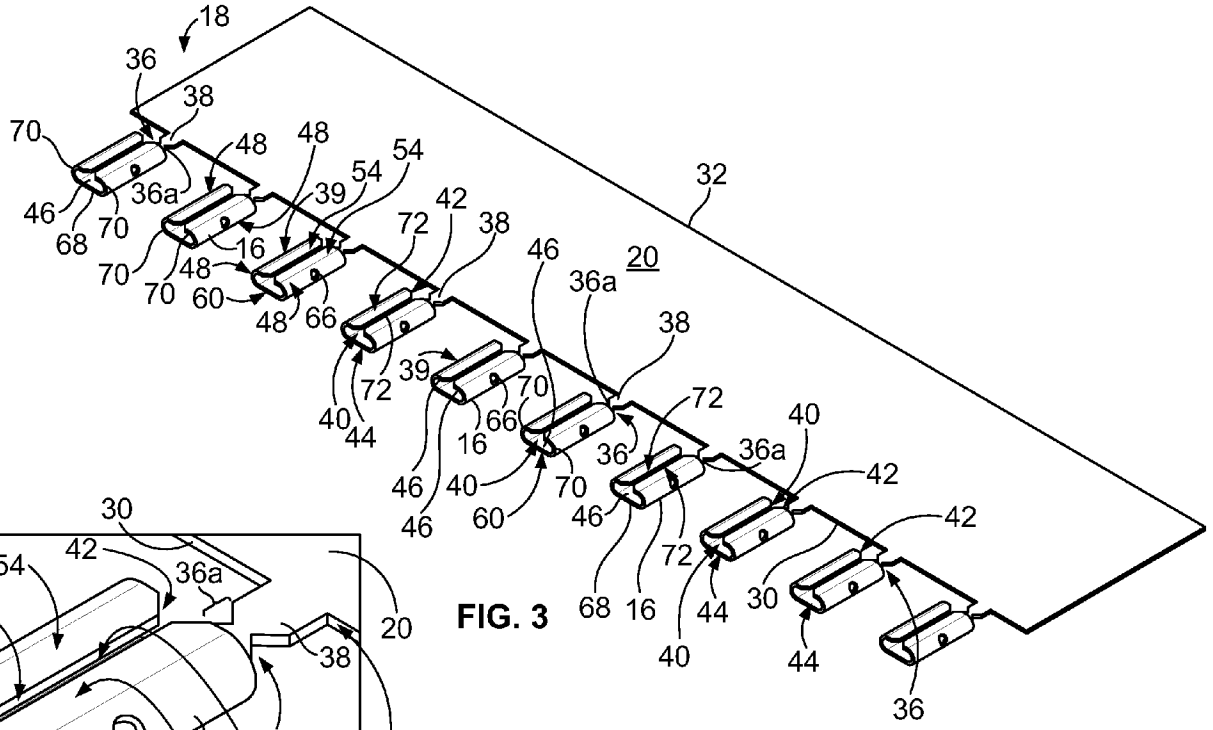
FIG. 3 is a perspective view of an embodiment of one of the terminal holders shown in FIG. 2.

FIG. 3 is a perspective view of an embodiment of a terminal holder 18. The terminal holder 18 includes the base plate 20 and the terminal sleeves 16. The base plate 20 extends from an edge 30 to an opposite edge 32. As will be described below, the base plate 20 is configured to be held proximate the end 34 (FIGS. 1, 2, and 5) of the cable 14 (FIGS. 1, 2, 5, and 6). For example, the base plate 20 is configured to be held proximate the end the 34 of the cable 14 such that the edge 30 is positioned proximate the terminals 26 (FIGS. 1, 2, 5, and 6) of the cable 14.

Figure 4:
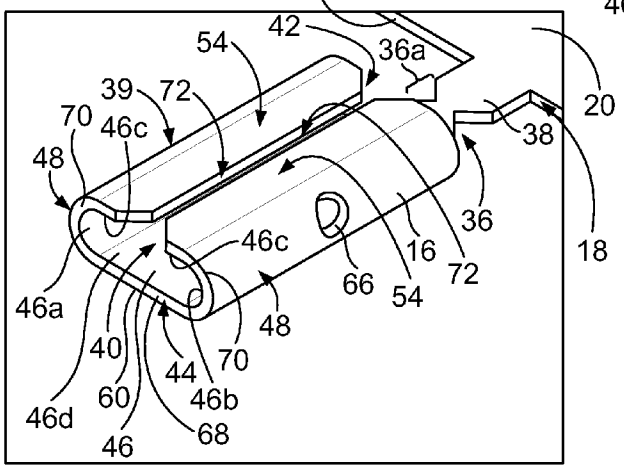
FIG. 4 is an enlarged perspective view of an embodiment of a terminal sleeve of the terminal holder shown in FIG. 3.

FIG. 4 is an enlarged perspective view of an embodiment of a terminal sleeve 16. Referring now to FIGS. 3 and 4, the terminal sleeves 16 extend outward from the edge 30 of the base plate 20. As briefly described above, the base plate 20 is configured to be separated from the terminal sleeves 16 after the connector 12 (FIGS. 1, 2, 5, and 6) and the cable 14 have been interconnected. The terminal sleeves 16 thus extend from the base plate 20 at separable interfaces 36. Specifically, strips 38 extend between, and interconnect, the terminal sleeves 16 and the edge 30 of the base plate 20. In the illustrated embodiment, the separable interfaces 36 are defined by necked-down segments 36*a* of the strips 38 that enable the base plate 20 to be separated from the terminal sleeves 16 by breaking (e.g., by bending) the strips 38 at the necked-down segments 36*a*. The separable interfaces 36 may be provided with any other structure in addition or alternative to the necked-down segments 36*a* to enable the base plate 20 and the strips 38 to be separated from the terminal sleeves 16.

Each terminal sleeve 16 includes a body 39 having an internal passage 40, which extends from a cable end 42 to a connector end 44. In the illustrated embodiment of the terminal sleeves 16, the internal passage 40 of each terminal sleeve 16 is configured to hold a single corresponding terminal 24 (FIGS. 1, 2, 5, and 6) of the connector 12 and a single corresponding terminal 26 of the cable 14 therein. But, in other embodiments, the terminal sleeves 16 may be configured to receive more than one terminal 24 or more than one terminal 26 therein. For example, a terminal sleeve 16 may be configured to receive two terminals of a connector that are arranged side by side with each other within the internal passage of the terminal sleeve (e.g., the terminal sleeves 116 shown in FIGS. 7-11). Another example includes receiving within the internal passage of a terminal sleeve a terminal from each of two cables that are stacked on each other such that a corresponding terminal of a connector may be sandwiched between the two terminals of the two cables within the internal passage of the terminal sleeve. As can be seen in FIG. 3, the cable end 42 of each internal passage 40 is open and faces generally toward the base plate 20 (i.e., generally toward the cable 14) for receiving the corresponding terminal 26 of the cable 14 through the cable end 42. The connector end 44 of each internal passage 40 is open and faces generally away from the base plate 20 (i.e., generally toward the connector 12) for receiving the corresponding terminal 24 of the connector 12 through the connector end 44. The cable end 42 may be referred to herein as a "first end" and/or a "second end". The connector end 44 may be referred to herein as a "first end" and/or a "second end".

As best seen in FIG. 4, the bodies 39 of the terminal sleeves 16 include internal surfaces 46. The internal surfaces 46 define the internal passages 40. The internal passages 40 are optionally sized and shaped relative to the corresponding terminals 24 and 26 such that the internal surfaces 46 stictionally engage the corresponding terminals 24 and 26 when the terminals 24 and 26 are received within the internal passages 40. Such stictional engagement enables the terminals sleeves 16 to grip the corresponding terminals 24 and 26 to thereby facilitate holding the terminals 24 and 26 as engaged in electrical contact with each other. For example, in the illustrated embodiment of the terminal sleeves 16, an internal surface 46*a* and 46*b* of a side segment 48 of each body 39 is configured to stictionally engage a respective side 50*a* and 50*b* (FIG. 2) of the corresponding terminal 24 and a respective side 52*a* and 52*b* (FIG. 2) of the corresponding terminal 26. The internal surfaces 46*a* and 46*b* will frictionally engage the respective sides 50*a* and 50*b* as the corresponding terminal 24 is inserted into the internal passage 40. The internal surfaces 46*a* and 46*b* will frictionally engage the respective sides 52*a* and 52*b* as the corresponding terminal 26 is inserted into the internal passage 40. Optionally, the internal passages 40 are sized and shaped relative to the corresponding terminals 24 and 26 such that an internal surface 46*c* at a top segment 54 of each body 39 stictionally engages a top 56 (FIGS. 2, 5, and 6) of the corresponding terminal 24 or a top 58 (FIGS. 2, 5, and 6) of the corresponding terminal 26 when both of the corresponding terminals 24 and 26 are received within the internal passage 40. Similarly, the internal passages 40 are optionally sized and shaped relative to the corresponding terminals 24 and 26 such that an internal surface 46*d* at a bottom segment 60 of each body 39 stictionally engages a bottom 62 (FIGS. 2, 5, and 6) of the corresponding terminal 24 or a bottom 64 (FIGS. 2, 5, and 6) of the corresponding terminal 26 when both of the corresponding terminals 24 and 26 are received within the internal passage 40.

Optionally, the bodies 39 of the terminal sleeves 16 include openings 66 for inspection of a solder joint, a weld joint, and/or a bond between the corresponding terminals 24 and 26 and/or between the terminals 24 and/or 26 and the corresponding body 39. In the illustrated embodiment of the terminal sleeves 16, the openings 66 extend through the side segments 48. But, the openings 66 may additionally or alternatively be located along any other segment of the bodies 39 (e.g., along the bottom segment 60 and/or the top segment 54). Each body 39 may include any number of openings 66.

The bodies 39 of the terminal sleeves 16 may have any geometry, which may be based on the geometry of the corresponding terminals 24 and 26. In the illustrated embodiment, the bottom segment 60 of each body 39 is defined by a base wall 68 and the side segments 48 and the top segment 54 of each body 39 are defined by sidewalls 70. As can be seen in FIGS. 3 and 4, the geometry of the side walls 70 are such that in the illustrated embodiment of the terminal sleeves 16, the side walls 70 are folded over the base wall 68 with free ends 72 of the side walls 70 opposing each other. The seam defined between the opposing free ends 72 may be used for inspection of one or more solder joints. The seam defined between the opposing free ends 72 may enable easier visible inspection and/or verification of one or more solder joints, weld joints, and/or bond joints as compared to at least some known assemblies. Each body 39 may additionally or alternatively have any other geometry.

In the illustrated embodiment of the terminal sleeves 16, the terminal sleeves 16 are fabricated from one or more electrically conductive materials such that the bodies 39 of the terminal sleeves 16 are electrically conductive. The terminal sleeves 16 may be fabricated from any electrically conductive material(s), such as, but not limited to, a metal, a non-electrically conductive material (i.e., an electrically insulative material that) is selectively plated and/or otherwise coated with an electrically conductive material, and/or the like. The base plate 20 may be fabricated from an electrically conductive material and/or a non-electrically conductive material.

The terminal sleeves 16 and the base plate 20 are optionally integrally fabricated from the same sheet of material as a single, unitary, continuous structure. One example of a process for integrally fabricating the terminal sleeves 16 and the base plate 20 from the same sheet of material as a continuous structure includes cutting the terminal sleeves 16 and the base plate 20 from a sheet of material and forming the cut structure into the finished shape of the bodies 39 and the base plate 20 shown herein, which may be referred to herein as a "cut and formed" structure. Any cutting process (es) may be used, such as, but not limited to, stamping, laser cutting, water cutting, plasma cutting, cutting using a cutting tool (e.g., a saw, a blade, and/or the like), and/or the like. Moreover, any forming process(es) may be used, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the base plate 20 and the terminal sleeves 16 have a stamped and formed structure that is stamped from a sheet of material.

Figure 5:
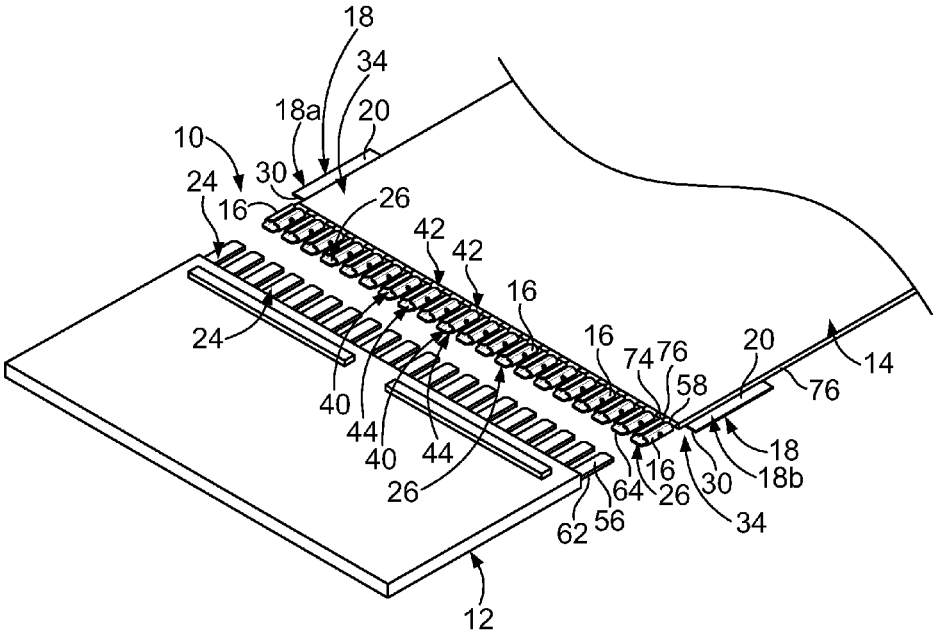
FIG. 5 is a partially exploded view of the connector and cable assembly shown in FIGS. 1 and 2 illustrating terminal sleeves installed to the cable using two terminal holders.

FIG. 5 is a partially exploded view of the connector and cable assembly 10 illustrating the terminal sleeves 16 installed to the cable 14 using two terminal holders 18. Specifically, and referring now to FIGS. 2 and 5, the terminal holder 18 shown in FIGS. 3 and 4 is used to connect the cable 14 to the connector 12. In the illustrated embodiment of the assembly 10, two terminal holders 18 are used to connect the cable 14 to the connector 12. The terminal holders 18*a* and 18*b* are stacked to provide terminal sleeves 16 that hold both even and odd terminals 24 and 26 of the connector 12 and cable 14, respectively. Specifically, as is best seen in FIG. 2, the terminal holders 18*a* and 18*b* are stacked such that the terminal sleeves 16 of the terminal holders 18*a* and 18*b* are interleaved with each other in an alternating pattern. The stack of the terminal holders 18*a* and 18*b* is positioned relative to the connector 12 and the cable 14 such that the terminal holder 18*a* holds the odd terminals 24 and 26 and the terminal holder 18*b* holds the even terminals 24 and 26 (beginning with the left-most terminals 24 and 26 and counting from left-to-right in FIG. 5). As should be appreciated from FIG. 5, the strips 38 (not visible in FIG. 5) of the base plate 18*b* are configured such that the terminal sleeves 16 of the terminal holder 18*b* extend approximately coplanar with the terminal sleeves 16 of the terminal holder 18*a*. Although two are shown in the illustrated embodiment of the assembly 10, any number of terminal holders 18 may be used to connect the cable 14 to the connector 12.

To connect the cable 14 to the connector 12, the terminals 26 of the cable 14 are inserted into the internal passages 40 of the corresponding terminal sleeves 16 of the terminal holders 18*a* and 18*b* through the cable ends 42 of the terminal sleeves 16. The base plates 20 of the terminal holders 18*a* and 18*b* are held proximate the end 34 of the cable 14, for example as is shown in FIG. 5. The base plates 20 of the terminal holders 18*a* and 18*b* are held proximate the end 34 of the cable 14 such that the terminals 26 are retained within the corresponding terminals sleeves 16, which may also be facilitated by the optional stiction (described above) between the terminal sleeves 16 and the corresponding terminals 26. The edges 30 of the base plates 20 may or may not be aligned with an edge 74 of insulation 76 of the cable 14. The base plates 20 may be held proximate the end 34 of the cable 14 using any method, structure, and/or the like, such as, but not limited to, a person's hand, a tool (e.g., a clamp and/or the like), and/or the like. In some embodiments, the optional stiction (described above) between the terminal sleeves 16 and the terminals 26 of the cable 14 may be sufficient to hold the base plates 20 of the terminal holders 18*a* and 18*b* proximate the end 34 of the cable 14.

Figure 6:
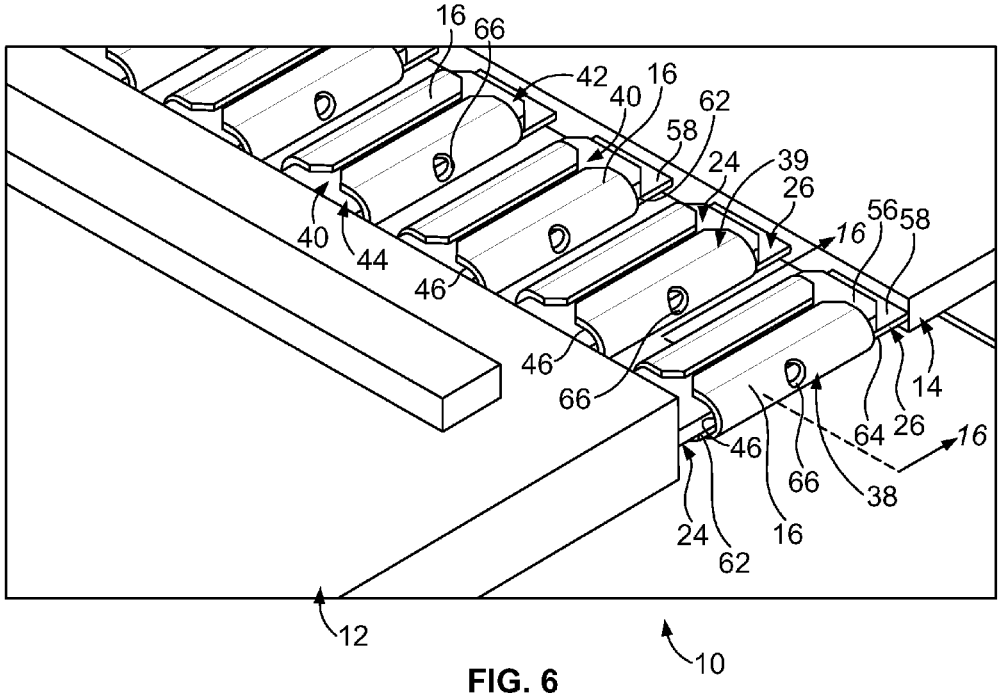
FIG. 6 is an enlarged perspective view of the connector and cable assembly shown in FIG. 1 as fully assembled.

FIG. 6 is an enlarged perspective view of the connector and cable assembly 10 as fully assembled. Referring now to FIGS. 5 and 6, the terminals 24 of the connector 12 are inserted into the internal passages 40 of the corresponding terminal sleeves 16 through the connector ends 44 of the terminal sleeves 16. As best seen in FIG. 6, in the illustrated embodiment of the assembly 10, the terminals 24 and 26 are held within the corresponding terminal sleeves 16 such that the bottoms 62 of the terminals 24 face the tops 58 of the corresponding terminals 26. But, alternatively the terminals 24 and 26 may be received within the corresponding terminal sleeves 16 such that the bottoms 64 of the terminals 26 face the tops 56 of the corresponding terminals 24.

Referring now to FIGS. 1 and 6, when the terminals 24 and 26 are received within the internal passages 40 of the corresponding terminal sleeves 16 as shown in FIGS. 1 and 6, corresponding terminals 24 and 26 are held by the corresponding terminal sleeves 16 such that the corresponding terminals 24 and 26 are engaged in electrical contact with each other. When the corresponding terminals 24 and 26 are engaged in electrical contact with each other, the corresponding terminals 24 and 26 are electrically connected together such that the corresponding terminals 24 and 26 provide an electrical pathway between the cable 14 and the connector 12. As used herein, corresponding terminals of a cable and a connector (or of two cables) may be "engaged in electrical contact" with each other via engagement in physical contact with each other (e.g., engagement in physical contact between the bottoms 62 (not labeled in FIG. 1) and the tops 58 (not labeled in FIG. 1) of corresponding terminals 24 and 26, respectively, or engagement in physical contact between the tops 56 and the bottoms 64 of corresponding terminals 24 and 26, respectively), via engagement in physical contact of corresponding terminals with the body of the corresponding terminal sleeve (e.g., in embodiments wherein the terminal sleeves are electrically conductive), via engagement through solder, via engagement through a weld, and/or via engagement through a bond (e.g., an epoxy, an adhesive, and/or the like). The optional stiction (described above) between the terminal sleeves 16 and the corresponding terminals 24 and/or 26 may facilitate the engagement in electrical contact between corresponding terminals 24 and 26, whether or not solder, a weld, and/or a bond is used and whether or not the terminal sleeves 16 are electrically conductive.

In some embodiments, physical contact between the corresponding terminals 24 and 26 and/or physical contact of corresponding terminals 24 and 26 with the body 39 of the corresponding terminal sleeve 16 may be sufficient to establish and/or maintain electrical contact (and thus an electrical connection) between the corresponding terminals 24 and 26.

In other embodiments, solder, a weld, and/or an electrically conductive bond (e.g., an epoxy, an adhesive, and/or the like) is used to establish and/or maintain electrical contact (and thus an electrical connection) between corresponding terminals 24 and 26, for example to facilitate enabling the fully assembled connector and cable assembly 10 to withstand vibration, thermal cycling, and/or the like.

In the illustrated embodiment of the assembly 10, solder is used to establish and maintain electrical contact between corresponding terminals 24 and 26. In the illustrated embodiment, corresponding terminals 24 and 26 are soldered to the corresponding terminal sleeve 16 and each other. Specifically, solder is pre-applied to the terminals 24 and 26 (i.e., the terminals 24 and 26 are pre-tinned), for example by dipping the terminals 24 and 26 in a hot molten solder. The terminals 24 and 26 are optionally fluxed after being pre-tinned. After the terminals 24 and 26 have been pre-tinned and fluxed, the terminals 24 and/or 26 are installed into the corresponding terminal sleeves 16 as described above and shown in FIGS. 1 and 6. The assembly 10 is thereafter submitted to a heating cycle such that all of the terminals 24 are connected to the corresponding terminals 26 at once (i.e., simultaneously). The terminal holders 18 and terminal sleeves 16 thereof thus enable mass termination of the terminals 24 and 26. Optionally, one or more of the internal surfaces 46 (not labeled in FIG. 1) and/or one or more external surfaces of the bodies 39 of the terminal sleeves 16 are coated (e.g., plated) with solder. In the illustrated embodiment, an approximate entirety of each body 39 (i.e., approximately all of the internal surfaces 46 and approximately all of the external surfaces of each body 39) is coated with solder. A coating (e.g., plating) thickness of the terminal sleeves 16 may be selected to enable the bodies 39 to act as a reservoir for supplying some or all of the solder used to solder corresponding terminals 24 and 26 to each other and to the corresponding terminal sleeves 16. In some embodiments, the coating (e.g., plating) thickness of the terminal sleeves 16 is sufficient such that pre-tinning of the terminals 24 and 26 is unnecessary.

The openings 66 described above may be used for inspection of one or more solder joints. The openings 66 and/or other geometry (e.g., the seam defined between the opposing free ends 72 of the side walls 70) of the terminal sleeves 16 may enable easier visible inspection and/or verification of one or more solder joints, weld joints, and/or bond joints as compared to at least some known assemblies.

Once the terminals 24 and 26 have been installed into the corresponding terminal sleeves 16, the base plates 20 (FIGS. 2-5) of the terminal holders 18*a* and 18*b* can be separated from the terminal sleeves 16 thereof to electrically isolate the terminal sleeves 16 (and thus the corresponding terminals 24 and 26 thereof) from each other. The base plates 20 are separated from the terminal sleeves 16 by breaking the separable interfaces 36 (FIGS. 3 and 4) of the strips 38 (FIGS. 2-4) that interconnect the terminal sleeves 16 to the base plates 20. In the illustrated embodiment, the base plates 20 are separated from the terminal sleeves 16 after the heating cycle (and optionally after inspection of any solder joints), which may facilitate preventing the action of separating a base plate 20 from disturbing the relative position of, and thereby the electrical contact between, corresponding terminals 24 and 26. But, in other embodiments, one or more of the base plates 20 may be separated from the terminal sleeves 16 thereof before the heating cycle has been applied to solder corresponding terminals 24 and 26 to each other and/or to the corresponding terminal sleeves 16. Similarly, a base plate 20 may be separated from the terminal sleeves 16 thereof before or after welding and before or after bonds have been formed (and optionally after inspection of any weld and/or bond joints).

As should be appreciated from the FIGS. 1-6 and the above description, the terminal holders 18 (FIGS. 2-5) align and accurately position corresponding terminals 24 and 26 of the connector 12 and the cable 14, respectively, with respect to each other. The terminal holders 18 thus enable the terminal sleeves 16 to be installed to the terminals 24 and 26 as a unit, as opposed to having to individually install each terminal sleeve 16 to the corresponding terminals 24 and 26. The terminal holders 18 may enable the cable 14 and the connector 12 to be interconnected by holding the assembly 10 in a single hand of a person.

Figure 7:
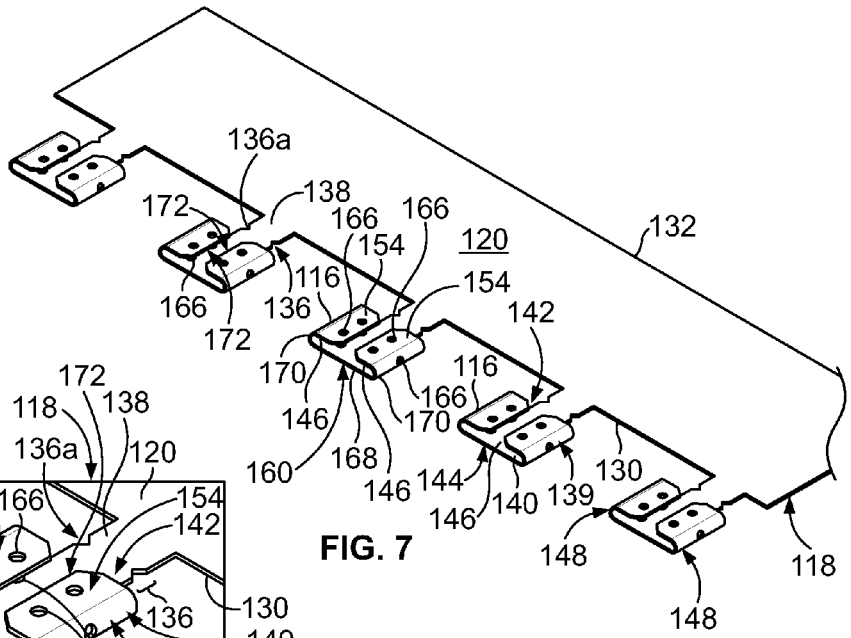
FIG. 7 is a perspective view of another embodiment of a terminal holder of a connector and cable assembly.

FIG. 7 is a perspective view of another embodiment of a terminal holder 118. The terminal holder 118 includes a base plate 120 and terminal sleeves 116. The base plate 120 extends from an edge 130 to an opposite edge 132.

Figure 8:
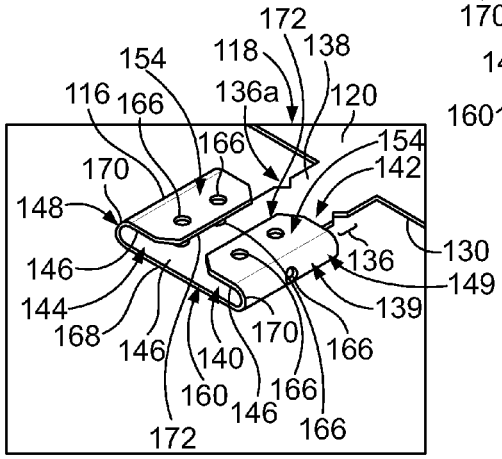
FIG. 8 is an enlarged perspective view of an embodiment of a terminal sleeve of the terminal holder shown in FIG. 7 illustrating an embodiment of a terminal sleeve that is configured to receive two corresponding terminals of a connector.
Figure 9:
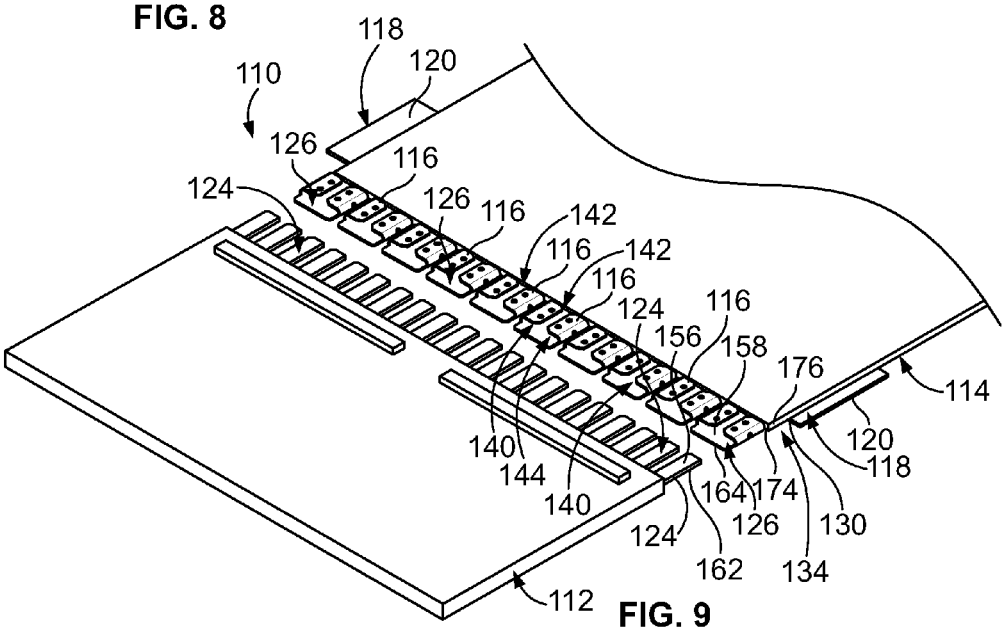
FIG. 9 is a partially exploded view of another embodiment of a connector and cable assembly illustrating terminal sleeves installed to the cable using two terminal holders.
Figure 10:
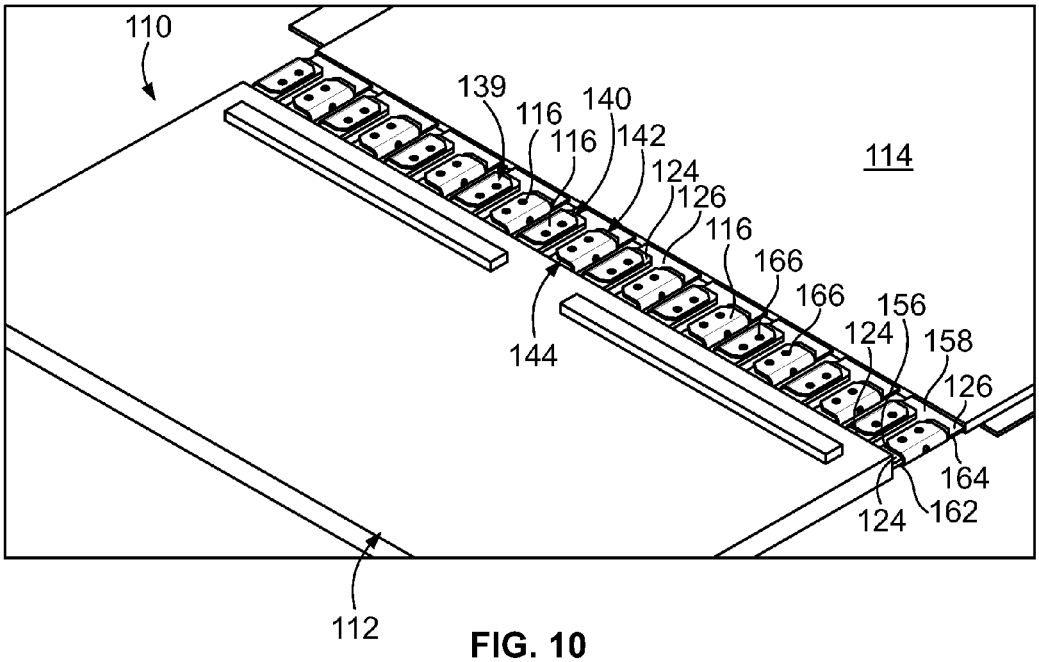
FIG. 10 is a perspective view of the connector and cable assembly shown in FIG. 9 as fully assembled.
Figure 11:
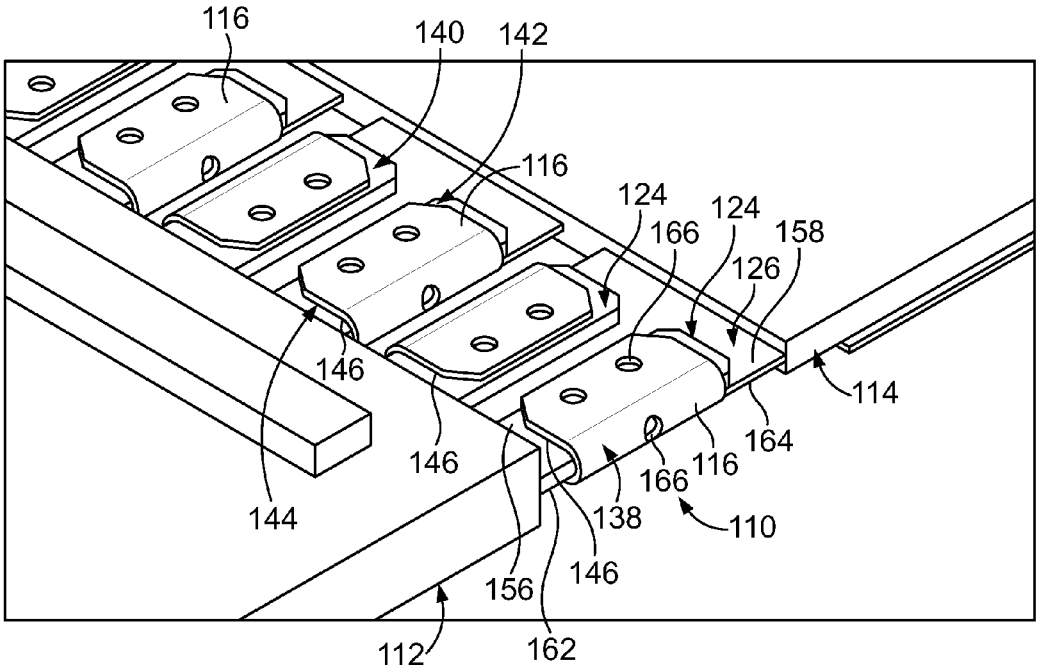
FIG. 11 is an enlarged perspective view of the connector and cable assembly shown in FIG. 10.

FIG. 8 is an enlarged perspective view of an embodiment of a terminal sleeve 116, which in the illustrated embodiment is configured to receive two corresponding terminals 124 (FIGS. 9-11) of an electrical connector 112 (FIGS. 9-11). Referring now to FIGS. 7 and 8, the terminal sleeves 116 extend outward from the edge 130 of the base plate 120. The base plate 120 is configured to be separated from the terminal sleeves 116. The terminal sleeves 116 thus extend from the base plate 120 at separable interfaces 136. Specifically, strips 138 extend between, and interconnect, the terminal sleeves 116 and the edge 130 of the base plate 120. In the illustrated embodiment, the separable interfaces 136 are defined by necked-down segments 136*a* of the strips 138 that enable the base plate 120 to be separated from the terminal sleeves 116 by breaking the strips 138 at the necked-down segments 136*a*. The separable interfaces 136 may be provided with any other structure in addition or alternative to the necked-down segments 136*a* to enable the base plate 120 to be separated from the terminal sleeves 116.

Each terminal sleeve 116 includes a body 139 having an internal passage 140, which extends from a cable end 142 to a connector end 144. As will be described below, in the illustrated embodiment of the terminal sleeves 116, the internal passage 140 of each terminal sleeve 116 is configured to hold two corresponding terminals 124 of the connector 112 and one (i.e., a single) corresponding terminal 126 (FIGS. 9-11) of an electrical cable 114 (FIGS. 9-11) therein. The cable end 142 may be referred to herein as a "first end" and/or a "second end". The connector end 144 may be referred to herein as a "first end" and/or a "second end".

As best seen in FIG. 8, the bodies 139 of the terminal sleeves 116 include internal surfaces 146 that define the internal passages 140. The internal passages 140 are optionally sized and shaped relative to the corresponding terminals 124 and 126 such that the internal surfaces 146 stictionally engage the corresponding terminals 124 and 126 when the terminals 124 and 126 are received within the internal passages 140. Such stictional engagement enables the terminals sleeves 116 to grip the corresponding terminals 124 and 126 to thereby facilitate holding the terminals 124 and 126 as engaged in electrical contact with each other.

Optionally, the bodies 139 of the terminal sleeves 116 include openings 166 for inspection of a solder joint, a weld joint, and/or a bond between the corresponding terminals 124 and 126 and/or between the terminals 124 and/or 126 and the corresponding body 139. In the illustrated embodiment of the terminal sleeves 116, the openings 166 extend through side segments 148, top segments 154, and bottom segments 160 of the bodies 139. But, the openings 166 may additionally or alternatively be located along any other segment of the bodies 139. Each body 139 may include any number of openings 166.

The bodies 139 of the terminal sleeves 116 may have any geometry, which may be based on the geometry of the corresponding terminals 124 and 126. In the illustrated embodiment, the bottom segment 160 of each body 139 is defined by a base wall 168 and the side segments 148 and the top segment 154 of each body 139 are defined by sidewalls 170. The geometry of the side walls 170 are such that in the illustrated embodiment of the terminal sleeves 116, the side walls 170 are folded over the base wall 168 with free ends 172 of the side walls 170 opposing each other. The seam defined between the opposing free ends 172 may be used for inspection of one or more solder joints. The seam defined between the opposing free ends 172 may enable easier visible inspection and/or verification of one or more solder joints, weld joints, and/or bond joints as compared to at least some known assemblies. Each body 139 may additionally or alternatively have any other geometry.

In the illustrated embodiment of the terminal sleeves 116, the terminal sleeves 116 are fabricated from one or more electrically conductive materials such that the bodies 139 of the terminal sleeves 116 are electrically conductive. The terminal sleeves 116 may be fabricated from any electrically conductive material(s), such as, but not limited to, a metal, a non-electrically conductive material (i.e., an electrically insulative material) that is selectively plated and/or otherwise coated with an electrically conductive material, and/or the like. The base plate 120 may be fabricated from an electrically conductive material and/or a non-electrically conductive material.

The terminal sleeves 116 and the base plate 120 are optionally integrally fabricated from the same sheet of material as a single, unitary, continuous structure. One example of a process for integrally fabricating the terminal sleeves 116 and the base plate 120 from the same sheet of material as a continuous structure includes cutting the terminal sleeves 116 and the base plate 120 from a sheet of material and forming the cut structure into the finished shape of the bodies 139 and the base plate 120 shown herein, which may be referred to herein as a "cut and formed" structure. Any cutting process(es) may be used, such as, but not limited to, stamping, laser cutting, water cutting, plasma cutting, cutting using a cutting tool (e.g., a saw, a blade, and/or the like), and/or the like. Moreover, any forming process(es) may be used, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the base plate 120 and the terminal sleeves 116 have a stamped and formed structure that is stamped from a sheet of material.

FIG. 9 is a partially exploded view of another embodiment of a connector and cable assembly 110 that includes the connector 112 and the cable 114. FIG. 9 illustrates the terminal sleeves 116 installed to the cable 114 using two terminal holders 118, though any number of terminal holders 118 may be used to connect the cable 114 to the connector 112. For example, in embodiments wherein the connector 112 connects to two different types of cables that are arranged side-by-side with each other (e.g., a two-inch wide connector that connects to two cables that have different terminal widths and are each an inch wide), four or more terminal holders (e.g., two terminal holders 18 and two terminal holders 118) may required to connect the connector 112 to the two different cables.

To connect the cable 114 to the connector 112, the terminals 126 of the cable 114 are inserted into the internal passages 140 of the corresponding terminal sleeves 116 of the terminal holder 118 through the cable ends 142 of the terminal sleeves 116. The base plate 120 of the terminal holder 118 is held proximate an end 134 of the cable 114. The base plate 120 of the terminal holder 118 is held proximate the end 134 of the cable 114 such that the terminals 126 are retained within the corresponding terminals sleeves 116, which may also be facilitated by the optional stiction (described above) between the terminal sleeves 116 and the corresponding terminals 126. The edge 130 of the base plate 120 may or may not be aligned with an edge 174 of insulation 176 of the cable 114. The base plate 120 may be held proximate the end 134 of the cable 114 using any method, structure, and/or the like, such as, but not limited to, a person's hand, a tool (e.g., a clamp and/or the like), and/or the like. In some embodiments, the optional stiction (described above) between the terminal sleeves 116 and the terminals 126 of the cable 114 may be sufficient to hold the base plate 120 of the terminal holder 118 proximate the end 134 of the cable 114. The terminals 126 may be referred to herein as "cable terminals" and/or "first terminals".

FIG. 10 is a perspective view of the connector and cable assembly 110. FIG. 11 is an enlarged perspective view of the connector and cable assembly 110. Referring now to FIGS. 9-11, the terminals 124 of the connector 112 are then inserted into the internal passages 140 of the corresponding terminal sleeves 116 through the connector ends 144 of the terminal sleeves 116. As best seen in FIG. 11, in the illustrated embodiment of the assembly 110, the terminals 124 and 126 are held within the corresponding terminal sleeves 116 such that bottoms 162 of the terminals 124 face tops 158 of the corresponding terminals 126. But, alternatively the terminals 124 and 126 may be received within the corresponding terminal sleeves 116 such that bottoms 164 of the terminals 126 face tops 156 of the corresponding terminals 124. The terminals 124 may be referred to herein as "connector terminals" and/or "second terminals".

Referring now to FIGS. 10 and 11, when the terminals 124 and 126 are received within the internal passages 140 of the corresponding terminal sleeves 116 as shown in FIGS. 10 and 11, corresponding terminals 124 and 126 are held by the corresponding terminal sleeves 116 such that the corresponding terminals 124 and 126 are engaged in electrical contact with each other. When the corresponding terminals 124 and 126 are engaged in electrical contact with each other, the corresponding terminals 124 and 126 are electrically connected together such that the corresponding terminals 124 and 126 provide an electrical pathway between the cable 114 and the connector 112. The optional stiction (described above) between the terminal sleeves 116 and the corresponding terminals 124 and/or 126 may facilitate the engagement in electrical contact between corresponding terminals 124 and 126, whether or not solder, a weld, and/or a bond is used and whether or not the terminal sleeves 116 are electrically conductive.

In some embodiments, physical contact between the corresponding terminals 124 and 126 and/or physical contact of corresponding terminals 124 and 126 with the body 139 of the corresponding terminal sleeve 116 may be sufficient to establish and/or maintain electrical contact (and thus an electrical connection) between the corresponding terminals 124 and 126. In other embodiments, solder, a weld, and/or an electrically conductive bond (e.g., an epoxy, an adhesive, and/or the like) is used to establish and/or maintain electrical contact (and thus an electrical connection) between corresponding terminals 124 and 126, for example to facilitate enabling the fully assembled connector and cable assembly 110 to withstand vibration, thermal cycling, and/or the like.

In the illustrated embodiment of the assembly 110, solder is used to establish and maintain electrical contact between corresponding terminals 124 and 126. In the illustrated embodiment, corresponding terminals 124 and 126 are soldered to the corresponding terminal sleeve 116 and each other. Specifically, solder is pre-applied to the terminals 124 and 126 (i.e., the terminals 124 and 126 are pre-tinned), for example by dipping the terminals 124 and 126 in a hot molten solder. The terminals 124 and 126 are optionally fluxed after being pre-tinned. After the terminals 124 and 126 have been pre-tinned and fluxed, the terminals 124 and/or 126 are installed into the corresponding terminal sleeves 116 as described above and shown in FIGS. 10 and 11. The assembly 110 is thereafter submitted to a heating cycle such that all of the terminals 124 are connected to the corresponding terminals 126 at once (i.e., simultaneously). The terminal holders 118 and terminal sleeves 116 thereof thus enable mass termination of the terminals 124 and 126. Optionally, one or more of the internal surfaces 146 (not labeled in FIG. 10) and/or one or more of the external surfaces of the bodies 139 of the terminal sleeves 116 are coated (e.g., plated) with solder. In the illustrated embodiment, an approximate entirety of each body 139 (i.e., approximately all of the internal surfaces 146 and approximately all of the external surfaces of each body 139) is coated with solder. A coating (e.g., plating) thickness of the terminal sleeves 116 may be selected to enable the bodies 139 to act as a reservoir for supplying some or all of the solder used to solder corresponding terminals 124 and 126 to each other and to the corresponding terminal sleeves 116. In some embodiments, the coating (e.g., plating) thickness of the terminal sleeves 116 is sufficient such that pre-tinning of the terminals 124 and 126 is unnecessary.

The openings 166 described above may be used for inspection of one or more solder joints. The openings 166 and/or other geometry (e.g., the seam defined between the opposing free ends 172 of the side walls 170) of the terminal sleeves 116 may enable easier visible inspection and/or verification of one or more solder joints, weld joints, and/or bond joints as compared to at least some known assemblies.

Once the terminals 124 and 126 have been installed into the corresponding terminal sleeves 116, the base plate 120 (FIGS. 7-9) of the terminal holder 118 can be separated from the terminal sleeves 116 thereof to electrically isolate the terminal sleeves 116 (and thus the corresponding terminals 124 and 126 thereof) from each other. The base plate 120 is separated from the terminal sleeves 116 by breaking the separable interfaces 136 (FIGS. 7 and 8) of the strips 138 (FIGS. 7 and 8) that interconnect the terminal sleeves 116 to the base plate 120. In the illustrated embodiment, the base plate 120 is separated from the terminal sleeves 116 after soldering (i.e., after the heating cycle) and optionally after inspection of any solder joints. Separating a base plate 120 from the corresponding terminal sleeves 116 after the heating cycle may facilitate preventing the action of separating the base plate 20 from disturbing the relative position of, and thereby the electrical contact between, corresponding terminals 124 and 126. But, in other embodiments, the base plate 120 may be separated from the terminal sleeves 116 before the heating cycle has been applied to solder corresponding terminals 124 and 126 to each other and/or to the corresponding terminal sleeves 116. Similarly, the base plate 120 may be separated from the terminal sleeves 116 thereof before or after welding and before or after bonds have been formed (and optionally after inspection of any weld and/or bond joints).

As should be appreciated from the FIGS. 7-11 and the above description, the terminal holder 118 aligns and accurately position corresponding terminals 124 and 126 of the connector 112 and the cable 114, respectively, with respect to each other. The terminal holder 118 thus enables the terminal sleeves 116 to be installed to the terminals 124 and 126 as a unit, as opposed to having to individually install each terminal sleeve 116 to the corresponding terminals 124 and 126. The terminal holder 118 may enable the cable 114 and the connector 112 to be interconnected by holding the assembly 110 in a single hand of a person.

Figure 12:
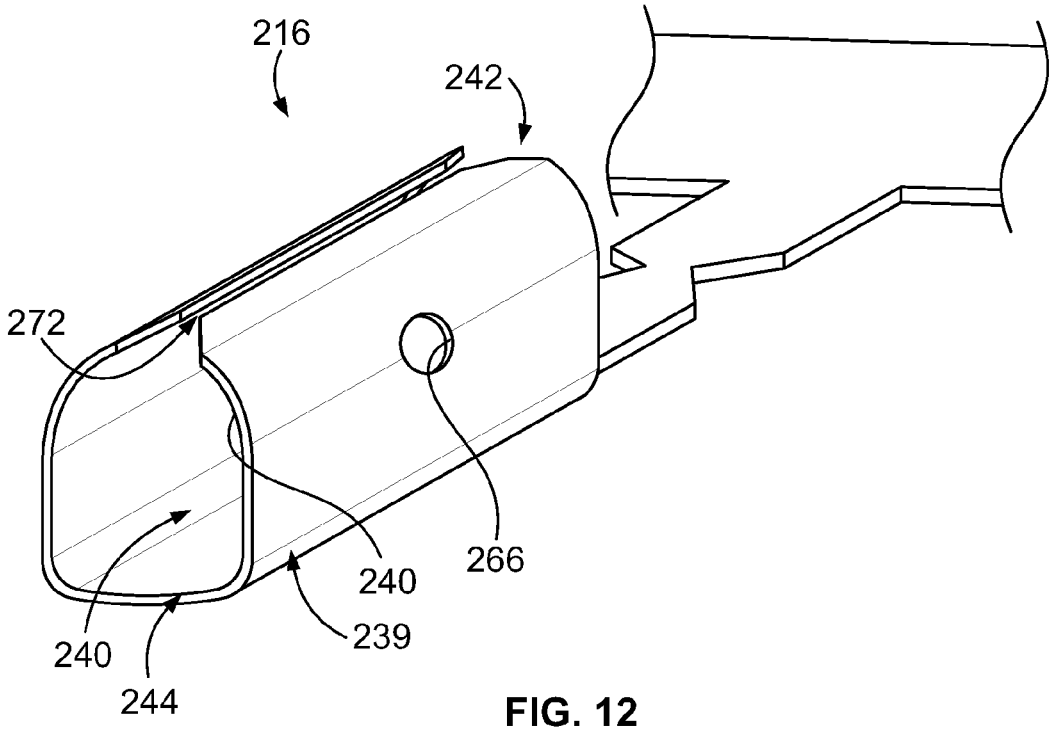
FIG. 12 is a perspective view of an embodiment of a terminal sleeve that is configured to receive a cylindrical terminal of an electrical cable.

As described above, the terminals 26 (FIGS. 1, 2, 5, 6, and 16) and 126 (FIGS. 9-11) may have an approximately cylindrical shape in some embodiments. FIG. 12 is a perspective view of an embodiment of a terminal sleeve 216 that is configured to receive a cylindrical terminal 226 (FIG. 13) of an electrical cable (not shown). The cylindrical terminal 226 may be a round wire or a cable. The design, manufacturing, plating, coating, and/or material of the terminal sleeve 216 that is used for connecting an electrical connector (not shown) to the cylindrical terminal 226 (e.g., the round wire) may be similar to the terminal sleeve 16.

The terminal sleeve 216 includes a body 239 having an internal passage 240, which extends from a wire end 242 to a connector end 244. The internal passage 240 is configured to hold the corresponding terminal 224 (FIG. 13) of an electrical connector (not shown) and the corresponding cylindrical terminals 226 of the cable. The illustrated embodiment of the terminal sleeve 216 is configured to receive a single corresponding terminal 224 of the connector and a single corresponding cylindrical terminal 226 of the cable within the internal passage 240; however other variations are possible in alternative embodiments. Specifically, the terminal sleeve 216 receives the corresponding terminal 226 of the cable into the internal passage 240 through the wire end 242, and the internal passage 240 receives the corresponding terminal 224 of the connector through the connector end 244. The wire end 242 may be referred to herein as a "cable end", a "first end", and/or a "second end". The connector end 244 may be referred to herein as a "first end" and/or a "second end".

Optionally, the body 239 of the terminal sleeve 216 includes one or more openings 266 for inspection of a solder joint, a weld joint, and/or a bond between the corresponding terminals 224 and 226 and/or between the terminals 224 and/or 226 and the body 239. The openings 266 may be located along any segment(s) of the body 239 and the body 239 may include any number of openings 266. A seam 272 defined between the opposing free ends may be used for inspection. The seam 272 defined between the opposing free ends may enable easier visible inspection and/or verification of one or more solder joints, weld joints, and/or bond joints as compared to at least some known assemblies.

Figure 13:
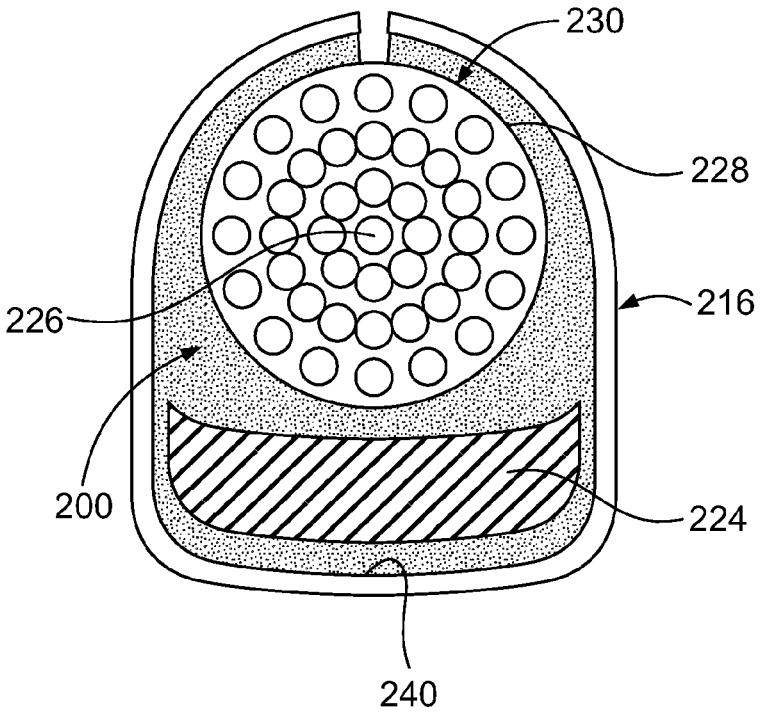
FIG. 13 is cross-sectional view illustrating a cylindrical terminal of an electrical cable engaged in electrical contact with a corresponding terminal of an electrical connector using the terminal sleeve shown in FIG. 12.

FIG. 13 is cross-sectional view illustrating the cylindrical terminal 226 of the cable engaged in electrical contact with the corresponding terminal 224 of the connector using the terminal sleeve 216. Specifically, the corresponding terminals 224 and 226 are received within the internal passage 240 of the terminal sleeve 216 and engaged in electrical contact with each other within the internal passage 240. In the illustrated embodiment, the terminals 224 and 226 are engaged in electrical contact with each other using optional solder 200. The terminal 224 may be referred to herein as a "connector terminal" and/or a "second terminal", while the terminal 226 may be referred to herein as a "cable terminal" and/or a "first terminal". The terminal 224 may be non-planar but cupped having one or both of the ends curved.

In the illustrated embodiment, the cylindrical terminal 226 is defined by an end 230 of a cylindrical conductor 228 of the cable. In some other embodiments, a pin terminal (not shown), or a terminal having another shape, and/or the like may terminate one or more of the conductors 228 of the cable. Moreover, although shown as being a cylindrical conductor 228 that has an approximately cylindrical shape, one or more of the conductors 228 of the cable alternatively may be non-cylindrical, such as an oblong or flattened shape.

When connecting the cable to the connector, the terminals 224 of the connector may be inserted into the internal passages 240 of the terminal sleeves 216 before the terminals 226 to ease handling of the cylindrical terminals 226 (i.e., to ease reception of the cylindrical terminals 226 within the wire end 242 of the terminal sleeves 216).

Figure 14:
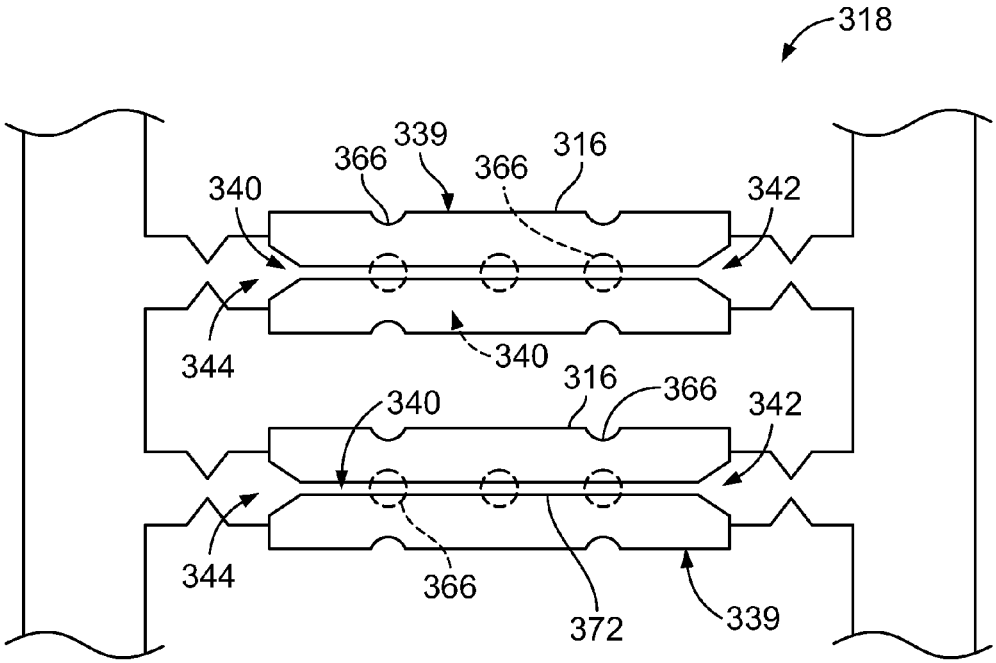
FIG. 14 is a plan view of a portion of an embodiment of a terminal holder having terminal sleeves configured to connect two electrical cables together.

As described above, the terminal sleeves and terminal holders described and illustrated herein are not limited to being used to connect a cable to a connector, but rather may alternatively be configured to connect two or more electrical cables together. FIG. 14 is a plan view of a portion of an embodiment of a terminal holder 318 that includes terminal sleeves 316 configured to connecting two electrical cables 314*a* (FIG. 15) and 314*b* (FIG. 15) together.

The terminal sleeves 316 include bodies 339 having internal passages 340 that include ends 342 and 344. Each internal passage 340 is configured to hold one or more corresponding terminals 326*a* (FIG. 15) of the cable 314*a* and one or more corresponding terminals 326*b* (FIG. 15) of the cable 314*b*. In the illustrated embodiment, each terminal sleeve 316 is configured to receive a single corresponding terminal 326*a* of the cable 314*a* and a single corresponding terminal 326*b* of the cable 314*b* within the internal passage 340. Specifically, each terminal sleeve 316 receives the corresponding terminal 326*b* of the cable 314*b* into the internal passage 340 through the end 342, and each internal passage 340 receives the corresponding terminal 326*a* of the cable 314*a* through the end 344. The end 342 may be referred to herein as a "cable end", "connector end", "first end", and/or a "second end". The end 344 may be referred to herein as a "cable end", "connector end", "first end", and/or a "second end". The design, manufacturing, plating, coating and/or material of the terminal sleeve 316 that is used for connecting the cylindrical terminals 326*a*, 326*b* may be similar to the terminal sleeve 16 or the terminal sleeve 216. The terminal sleeves 316 may be carried between two base plates for protection through handling.

Optionally, the bodies 339 of the terminal sleeves 316 include one or more openings 366 for inspection of a solder joint, a weld joint, and/or a bond between the corresponding terminals 326*a* and 326*b* and/or between the terminals 326*a* and/or 326*b* and the corresponding bodies 339. The openings 366 may be located along any segment(s) of each body 339 and each body 339 may include any number of openings 366. A seam 372 defined between the opposing free ends may be used for inspection. The seam 372 defined between the opposing free ends may enable easier visible inspection and/or verification of one or more solder joints, weld joints, and/or bond joints as compared to at least some known assemblies.

Figure 15:
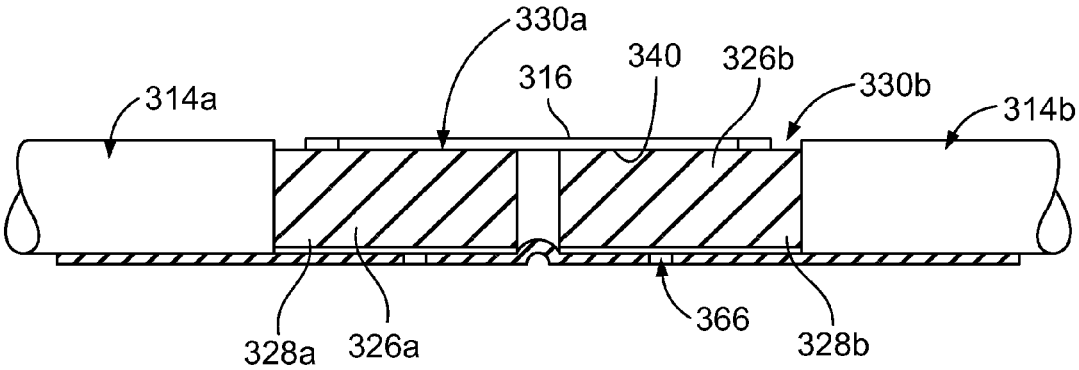
FIG. 15 is cross-sectional view illustrating corresponding terminals of the two electrical cables as engaged in electrical contact with each other using the terminal sleeves shown in FIG. 14.

FIG. 15 is cross-sectional view illustrating corresponding terminals 326*a* and 326*b* of the two electrical cables 314*a* and 314*b*, respectively, as engaged in electrical contact with each other using one of the terminal sleeves 316. Specifically, the corresponding terminals 326*a* and 326*b* are received within the internal passage 340 of the terminal sleeve 316 and engaged in electrical contact with each other within the internal passage 340. Although shown as having cylindrical shapes, the terminal 326*a* and/or the corresponding terminal 326*b* may have any other shape, such as, but not limited to, and approximately flat shape. The terminals 326*a* and 326*b* each may be referred to herein as a "cable terminal", "connector terminal", "first terminal", and/or "second terminal".

In the illustrated embodiment, the terminals 326*a* and 326*b* are each defined by a respective end 330*a* and 330*b* of a respective cylindrical conductor 328*a* and 328*b* of the respective cable 314*a* and 314*b*. In some other embodiments, a pin terminal (not shown), an approximately flat terminal, and/or the like may terminate one or more of the conductors 328*a* of the cable 314*a* and/or may terminate one or more of the conductors 328*b* of the cable 314*b*. Moreover, although shown as being cylindrical conductors 328*a* and 328*b* that each have an approximately cylindrical shape, one or more of the conductors 328*a* and/or 328*b* alternatively may be an approximately flat conductor.

Figure 16:
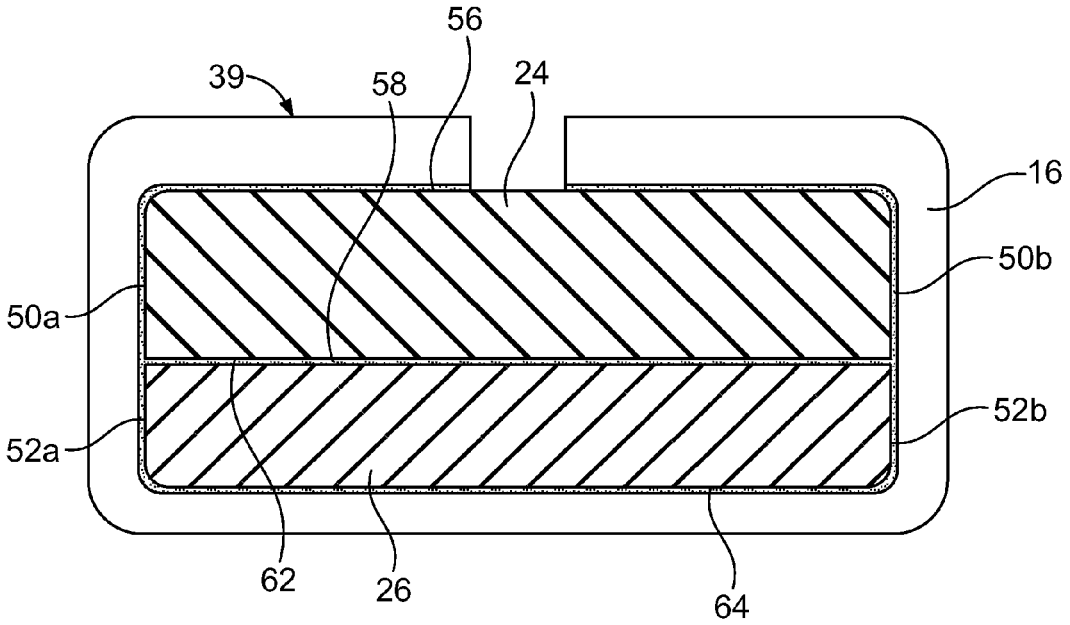
FIG. 16 is a cross-sectional view taken along line 16-16 of FIG. 6 illustrating a soldering embodiment of the connector and cable assembly shown in FIGS. 1 and 6 as fully assembled.

The embodiments described and/or illustrated herein may provide an assembly that is suitable for use in outer space and/or earth orbit environments. For example, the embodiments described and/or illustrated herein may provide an assembly that is suitable for use onboard a satellite. The embodiments described and/or illustrated herein may provide an assembly having an increased number of solder, weld, and/or bonding joints as compared to at least some known assemblies. For example, in at least some known assemblies, only the bottoms 62 (FIGS. 2, 5, 6, and 16) and the tops 58 (FIGS. 2, 5, 6, and 16) of corresponding terminals 24 and 26 are soldered together. But, in some embodiments of the subject matter described and/or illustrated herein, the tops 56 of the terminals 24, the bottoms 64 of the terminals 26, the sides 50*a* and/or 50*b* of the terminals 24, and/or the sides 52*a* and/or 52*b* of the terminals 26 are soldered to the body 39 of the corresponding terminal sleeve 16 in addition or alternative to the soldering of the bottoms 62 and tops 58 together, for example as is shown in FIG. 16. The embodiments described and/or illustrated herein may provide an assembly having an increased strength of solder joints, weld joints, mechanical connection joints (e.g., stiction joints), and/or bonding joints as compared to at least some known assemblies.

The embodiments described and/or illustrated herein may provide an assembly that does not require solder joints, weld joints, and/or bonding joints, for example an assembly that does not require such joints but may still be electrically connected and suitable for use in outer space and/or earth orbit environments (e.g., onboard a satellite and/or the like). The embodiments described and/or illustrated herein may provide an assembly that does not require the use of new tools (i.e., can use existing tools; e.g., heating tools and/or the like) to interconnect a connector and a cable, to interconnect connectors, and/or to interconnect cables. The embodiments described and/or illustrated herein may provide an assembly that can be interconnected by holding the assembly in a single hand of a person. The embodiments described and/or illustrated herein may provide an assembly having terminals that can be mass terminated. The embodiments described and/or illustrated herein may provide termination of a flat cable to a connector, of a round wire to a connector, of a flat cable to a flat cable, of a round wire to a round wire, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A terminal holder for connecting a cable to a connector or another cable, the terminal holder comprising:

a base plate configured to be held proximate an end of the cable, the base plate comprising an edge;

terminal sleeves extending from the edge of the base plate for holding cable terminals of the cable and connector terminals of the connector or of the other cable, the terminal sleeves having internal passages extending from a cable end to a connector end, the internal passage being configured to receive a corresponding cable terminal therein through the cable end, the internal passage being configured to receive a corresponding connector terminal therein through the connector end such that the corresponding cable terminal and the corresponding connector terminal are engaged in electrical contact with each other within the internal passage;

wherein the base plate is configured to be separated from the terminal sleeves once the corresponding cable and connector terminals have been terminated to the terminal sleeves to electrically isolate each terminal sleeve from each other terminal sleeve.

2. The terminal holder of claim 1, wherein the terminal sleeves comprise internal surfaces that at least partially define the internal passages, the internal surfaces being configured to stictionally engage the corresponding cable terminal and the corresponding connector terminal.

3. The terminal holder of claim 1, wherein the cable terminals and the connector terminals each include four sides, the terminal sleeves comprising bodies that are configured to extend around at least a majority of each of the four sides of the corresponding cable terminal and the corresponding connector terminal.

4. The terminal holder of claim 1, wherein the terminal sleeves are configured to be soldered to the corresponding cable and connector terminals.

5. The terminal holder of claim 1, wherein the base plate is configured to be separated from the terminal sleeves once the corresponding cable and connector terminals have been at least one of soldered, welded, or bonded together.

6. The terminal holder of claim 1, wherein the terminal sleeves include base walls and side walls, the side walls being folded over the base wall such that free ends of the side walls oppose each other.

7. The terminal holder of claim 1, wherein the base plate and the terminal sleeves have a cut and formed structure that is cut from a sheet of material.

8. The terminal holder of claim 1, wherein the terminal sleeves are configured to hold approximately flat cable terminals and approximately flat connector terminals.

9. The terminal holder of claim 1, wherein the terminal sleeves are configured to hold at least one approximately cylindrical terminal.

10. The terminal holder of claim 1, wherein the terminal sleeves are configured to hold a cupped connector terminal.

11. The terminal holder of claim 1, wherein the base plate and the terminal sleeves are stamped and formed from a common, unitary body with each terminal sleeve discreet from each other terminal sleeve and extending from the base plate at separable interfaces, the base plate being separated from the discrete terminal sleeves at the separable interfaces.

12. A connector and cable assembly comprising:

a cable having cable terminals;

a connector having connector terminals; and terminal sleeves extending from an edge of a base plate for holding the cable terminals and the connector terminals, the terminal sleeves having internal passages extending from a cable end to a connector end, the internal passage being configured to hold a corresponding cable terminal received through the cable end, the internal passage being configured to hold a corresponding connector terminal received through the connector end such that the corresponding cable terminal and the corresponding connector terminal are engaged in electrical contact with each other within the internal passage;

wherein the base plate is configured to be separated from the terminal sleeves once the corresponding cable and connector terminals have been terminated to the terminal sleeves to electrically isolate each terminal sleeve from each other terminal sleeve.

13. The connector and cable assembly of claim 12, wherein the terminal sleeves comprise internal surfaces that at least partially define the internal passages, the internal surfaces being configured to stictionally engage the corresponding cable terminal and the corresponding connector terminal.

14. The connector and cable assembly of claim 12, wherein corresponding cable and connector terminals are configured to be soldered to at least one of each other or the corresponding terminal sleeve.

15. The connector and cable assembly of claim 12, wherein the base plate is configured to be separated from the terminal sleeves thereof once the cable terminals and the connector terminals are held by the terminal sleeves and fully terminated using at least one of solder, a weld, or a bond.

16. The connector and cable assembly of claim 12, wherein the terminal sleeves include base walls and side walls, the side walls being folded over the base wall such that free ends of the side walls oppose each other.

17. The connector and cable assembly of claim 12, wherein the cable is a ribbon cable, the cable terminals are approximately flat, and the connector terminals are approximately flat.

18. The connector and cable assembly of claim 12, wherein each terminal sleeve is configured to hold two connector terminals or is configured to hold two cable terminals.

19. A method for connecting a cable to a connector or another cable, the method comprising:

inserting first terminals of the cable into first ends of terminal sleeves that extend from a base plate;

holding the base plate proximate an end of the cable such that the first terminals are retained within the terminal sleeves; and inserting second terminals of the connector or other cable into second ends of the terminal sleeves such that corresponding first and second terminals are engaged in electrical contact with each other within the corresponding terminal sleeve; and separating the base plate from the terminal sleeves such that each terminal sleeve is electrically isolated from each other terminal sleeve.

20. The method of claim 19, further comprising soldering corresponding first and second terminals to the corresponding terminal sleeve.

* * * * *